US011000071B2

(12) United States Patent
Borkovec et al.

(10) Patent No.: US 11,000,071 B2
(45) Date of Patent: May 11, 2021

(54) ELECTRONIC SMOKING DEVICE WITH ADDITIVE RESERVOIR

(71) Applicant: Fontem Holdings 1 B.V., Amsterdam (NL)

(72) Inventors: Vaclav Borkovec, Hamburg (DE); Neha Daryani, Hamburg (DE); Simon James Smith, Cambridge (GB); Henry Matthew Lawrence Fletcher, Cambridge (GB)

(73) Assignee: Fontem Holdings 1 B.V., Amsterdam (NL)

( * ) Notice: Subject to any disclaimer, the term of this patent is extended or adjusted under 35 U.S.C. 154(b) by 186 days.

(21) Appl. No.: 15/756,395

(22) PCT Filed: Aug. 24, 2016

(86) PCT No.: PCT/EP2016/069959
§ 371 (c)(1),
(2) Date: Feb. 28, 2018

(87) PCT Pub. No.: WO2017/036879
PCT Pub. Date: Mar. 9, 2017

(65) Prior Publication Data

US 2018/0242637 A1 Aug. 30, 2018

(30) Foreign Application Priority Data

Aug. 28, 2015 (EP) ..... 15183017

(51) Int. Cl.
*A24F 40/42* (2020.01)
*A24F 47/00* (2020.01)
*A24B 15/167* (2020.01)

(52) U.S. Cl.
CPC ..... *A24F 47/008* (2013.01); *A24B 15/167* (2016.11); *A24F 40/42* (2020.01)

(58) Field of Classification Search
CPC ..... A24F 47/008
USPC ..... 131/329
See application file for complete search history.

(56) References Cited

U.S. PATENT DOCUMENTS

2013/0192615 A1 8/2013 Tucker et al.
2014/0366898 A1 12/2014 Monsees et al.
2015/0027454 A1* 1/2015 Li ..... A24F 47/008 131/328
2016/0128384 A1* 5/2016 Luciani ..... A24F 47/008 131/329

(Continued)

FOREIGN PATENT DOCUMENTS

CN 103338662 A 10/2013
CN 103689812 A 4/2014
CN 103917119 A 7/2014

(Continued)

*Primary Examiner* — Michael H. Wilson
*Assistant Examiner* — Katherine A Will
(74) *Attorney, Agent, or Firm* — Dykema Gossett PLLC

(57) ABSTRACT

The invention relates to an electronic smoking device (10) and an additive reservoir (162). In order to be able to supply additive to liquid atomized by the electronic smoking device (10) at the user's choice, the electronic smoking device (10) comprises an additive inlet conduit (44) and the additive reservoir (162) comprises an additive outlet opening (72) that can be brought into communication with the additive inlet conduit (44).

20 Claims, 4 Drawing Sheets

(56) References Cited

U.S. PATENT DOCUMENTS

| | | | | |
|---|---|---|---|---|
| 2016/0157522 | A1* | 6/2016 | Zhu | A24F 47/008 131/329 |
| 2019/0230993 | A1* | 8/2019 | Buchberger | A24F 47/008 |

FOREIGN PATENT DOCUMENTS

| | | | |
|---|---|---|---|
| CN | 104248043 | A | 12/2014 |
| CN | 204147375 | U | 2/2015 |
| CN | 105142433 | A | 12/2015 |
| WO | 2015038981 | A2 | 3/2015 |

* cited by examiner

ELECTRONIC SMOKING DEVICE WITH ADDITIVE RESERVOIR

FIELD OF INVENTION

The present invention relates generally to additive reservoirs for electronic smoking devices and to electronic smoking devices, in particular electronic cigarettes.

BACKGROUND OF THE INVENTION

An electronic smoking device, such as an electronic cigarette (e-cigarette), typically has an outer housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic smoking devices, an airflow sensor is provided within the electronic smoking devices, which detects a user puffing on the device (e.g., by sensing an under-pressure or an air flow pattern through the device). The airflow sensor indicates or signals the puff to the control electronics to power up the device and generate vapor. In other electronic smoking devices, a switch is used to power up the electronic smoking device to generate a puff of vapor.

It is known to provide base liquids to be atomized with an electronic smoking device with a flavor material.

SUMMARY OF THE INVENTION

In accordance with one aspect of the present invention, an electronic smoking device is provided. The electronic smoking device comprises an air inhalation port and an outer housing. In the outer housing, an atomizer, a liquid reservoir for liquid to be atomized by the atomizer, and a duct are arranged. The duct interconnects the atomizer and the air inhalation port, for example in an aerosol-transmitting manner. The electronic smoking device comprises at least one additive inlet conduit. The at least one additive inlet conduit interconnects the duct and the surroundings of the electronic smoking device. The at least one additive inlet conduit extends through a lateral side of the outer housing. The electronic smoking device further comprises an additive reservoir with a receiving channel and with an additive outlet opening. The additive outlet opening opens into the receiving channel. The additive reservoir is detachably fixed at the outer housing and the at least one additive inlet conduit is in communication with the additive outlet opening. Furthermore, in accordance with another aspect of the present invention, an additive reservoir for an electronic smoking device, in particular for the electronic smoking device of the one aspect of the present invention, is provided. The additive reservoir comprises an additive storage volume, a receiving channel and an inner lateral surface arranged between the additive storage volume and the receiving channel. The additive reservoir comprises at least one additive outlet opening that interconnects the additive storage volume and the receiving channel.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
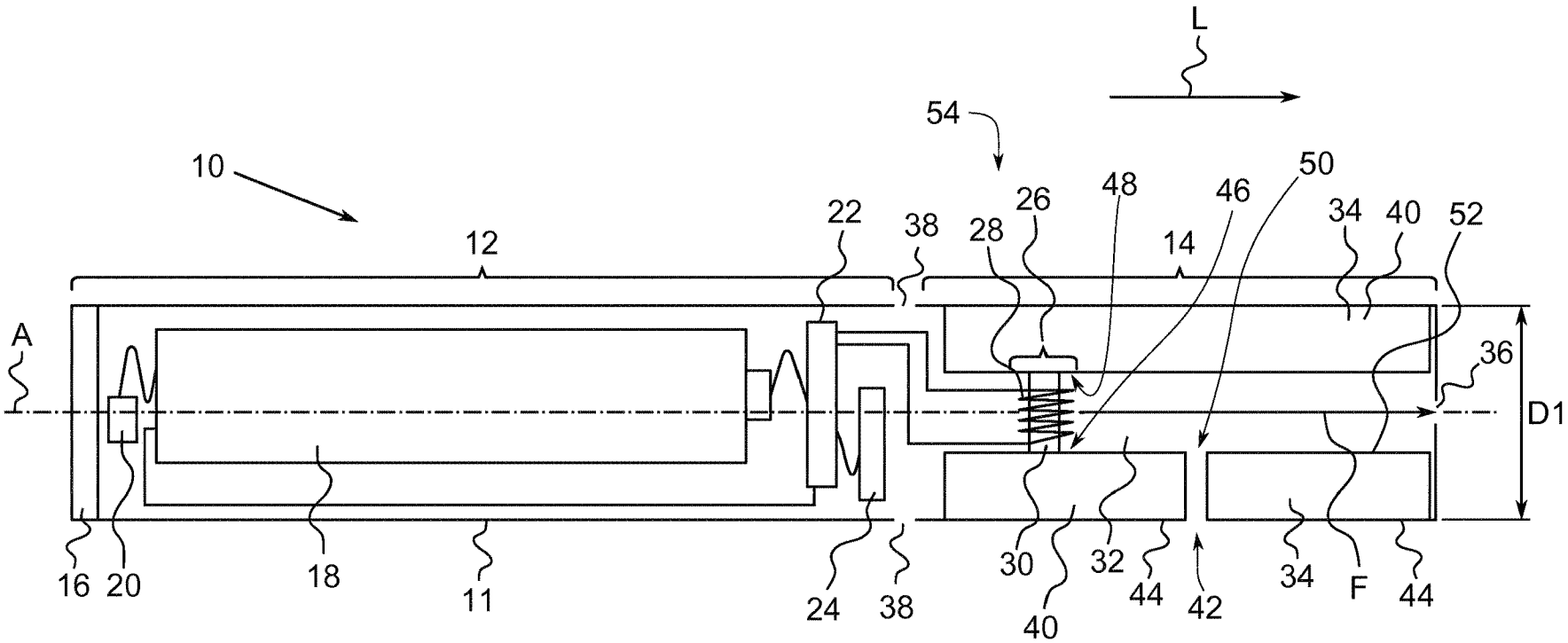
FIG. 1 is a schematic cross-sectional illustration of an exemplary embodiment of the electronic smoking device.

Throughout the following, an electronic smoking device, for example an e-cigarette, will be exemplarily described. As is shown in FIG. 1, an electronic smoking device 10 typically has an outer housing 11 comprising a cylindrical hollow tube having an end cap 16. The cylindrical hollow tube may be a single-piece or a multiple-piece tube. In FIG. 1, the cylindrical hollow tube is shown as a two-piece structure having a battery portion 12 and an atomizer/liquid reservoir portion 14. Together the battery portion 12 and the atomizer/liquid reservoir portion 14 form the cylindrical tube, which can be approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of metal, e.g. steel or aluminum, or of hardwearing plastic and act together with the end cap 16 to provide the outer housing 11 to contain the components of the electronic smoking device 10. The battery portion 12 and an atomizer/liquid reservoir portion 14 may be configured to fit together by a friction push fit, a snap fit, or a bayonet attachment, magnetic fit, or screw threads. In the alternative, the battery portion 12 and the atomizer/liquid reservoir portion 14 are formed as a single piece and share for example the cylindrical hollow tube.

The end cap 16 is provided at the front end of the battery portion 12. The end cap 16 may be made from translucent plastic or other translucent material to allow a light-emitting diode (LED) 20 positioned near the end cap to emit light through the end cap 16. The end cap 16 can be made of metal or other materials that do not allow light to pass.

An air inlet may be provided in the end cap 16, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, the LED 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the electronic smoking device 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a duct 32, e.g. a central passage, of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer 26 may alternatively use other forms of heating elements, such as ceramic heaters, or fiber or mesh material heaters. Nonresistance heating elements such as sonic, piezo and jet spray may also be used in the atomizer in place of the heating coil.

For example, the duct 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28. In the alternative, the duct 32 has all features of the central passage 32 but its position may be arranged adjacent to the hollow table.

The liquid reservoir 34 may alternatively include wadding soaked in liquid which encircles the duct 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap. The duct 32 interconnects the atomizer 26 and the air inhalation port 36, e.g. in an aerosol guiding manner.

In use, a user sucks on the electronic smoking device 10. This causes air to be drawn into the electronic smoking device 10 via one or more air inlets, such as air inlets 38, and to be drawn through the duct 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the duct 32. As the user continues to suck on the electronic smoking device 10, this aerosol is drawn through the duct 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some electronic smoking devices are intended to be disposable and the electric power in the battery 18 is intended to be sufficient to vaporize the liquid contained within the liquid reservoir 34, after which the electronic smoking device 10 is thrown away. In other embodiments the battery 18 is rechargeable or replaceable and the liquid reservoir 34 is refillable or replaceable. In the cases where the liquid reservoir 34 is a toroidal cavity, this may be achieved by refilling the liquid reservoir 34 via a refill port. In other embodiments the atomizer/liquid reservoir portion 14 of the electronic smoking device 10 is detachable from the battery portion 12 and another atomizer/liquid reservoir portion 14 can be fitted with another liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The replacement liquid reservoir 34 may be in the form of a cartridge having a duct 32 through which a user inhales aerosol. In other embodiments, aerosol may flow around the exterior of the cartridge 32 to an air inhalation port 36.

Of course, in addition to the above description of the structure and function of a typical electronic smoking device 10, variations also exist. For example, the LED 20 may be omitted. The airflow sensor 24 may be placed adjacent the end cap 16 rather than in the middle of the electronic smoking device 10. The airflow sensor 24 may be replaced with a switch which enables a user to activate the electronic smoking device 10 manually rather than in response to the detection of a change in air flow or air pressure.

Different types of atomizers 26 may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

The liquid reservoir 34 is shown in FIG. 1 arranged in the atomizer/liquid reservoir portion 14, which is connected to the battery portion 12 to form the electronic smoking device 10.

The liquid reservoir 34 comprises a storage volume 40 and an additive inlet conduit 42 that opens into an outer lateral surface 44 of the atomizer/liquid reservoir portion 14, for example of its part of the outer housing 11 that may be the hollow tube, and into the duct 32, e.g. the central passage. The additive inlet conduit 42 is shown extending through the liquid reservoir 34.

The liquid reservoir 34 comprises a liquid outlet 46 that is adapted to be coupled to the atomizer 26 of the electronic smoking device 10 in a liquid-transmitting manner. The liquid outlet 46 is in communication with the storage volume 40, such that liquid stored in the storage volume 40 can be transmitted from the storage volume 40 to the atomizer 26 via the liquid outlet 46. The liquid reservoir 34 is shown with two liquid outlets 46, 48, via which liquid can be transmitted from the storage volume 40 the atomizer 26 and in particular to the wick 30 of the atomizer 26. For example, the wick 30 extends at least into the liquid outlet 46 or, in case two liquid outlets 46, 48 are provided, into both of the liquid outlets 46, 48.

The liquid reservoir 34 of the exemplary embodiment of FIG. 1 furthermore comprises an additive inlet opening 50 arranged on an inner lateral surface 52 of the liquid reservoir 32, the inner lateral surface 52 abutting on the duct 32, e.g. the central passage. The additive inlet opening 50 is adapted to let gas or aerosol flow freely from the outside of the electronic smoking device 10 via the additive inlet conduit 42 into the central passage 32. The additive inlet opening 50 forms a mouth or outlet of the additive inlet conduit 42, via which the additive inlet conduit 42 opens into a flow path F formed by the duct 32, for example by the central passage 32. In particular, the additive inlet opening 50 is not directly connected to any atomizer in a fluid- or liquid-transmitting manner, but freely releases gaseous or aerosol particles into the duct 32.

The liquid outlet 46 and optionally the liquid outlets 46, 48 and the additive inlet 50 are arranged on the same inner lateral surface 52 of the liquid reservoir 34. In the exemplary embodiment of FIG. 1, the inner lateral surface 52 borders on the duct 32. Alternatively, in case the liquid reservoir 34 is not provided with a duct formed as central passage 32, the inner lateral surface 52 borders on the flow path F for atomized liquid that flows from the atomizer 26 along the flow path F to the air inhalation port 36 when a user of the electronic smoking device 10 puffs on the electronic smoking device 10.

The liquid outlet 46 or the liquid outlets 46, 48 and the additive inlet opening 50 are arranged at a distance to each other in a longitudinal direction L of the liquid reservoir 34. At least a section of the lateral surface 52, the duct 32 and/or a part of the flow path F extends along the longitudinal direction L. The longitudinal direction L of the liquid reservoir 34 may extend parallel to a central axis A of the liquid reservoir 34, which can correspond to the central axis of the atomizer/liquid reservoir portion 14 and/or of the electronic smoking device 10.

The inner lateral surface 52 of the exemplary embodiment of FIG. 1 is plane or flush and extends completely parallel to the longitudinal direction L, such that the duct 32, e.g. the central passage, has a constant inner diameter perpendicular to the longitudinal direction L, thereby facilitating producibility of the liquid reservoir 34

In case the liquid reservoir 34 is provided separately from other components of the electronic smoking device 10 or of the atomizer/liquid reservoir portion 14, the duct formed as central passage may be designated as a center through hole that extends along the longitudinal direction L. The inner lateral surface 52 is then an inner lateral surface that adjoins the center through hole.

The liquid reservoir 34 may be filled at least partially with a liquid to be atomized and an additive, e.g. a flavor. The storage volume 40 comprises the liquid to be atomized by the electronic smoking device 10. Via the additive supply duct 42, the additive to be added to the atomized liquid can be supplied to the atomized liquid.

The additive may comprise compounds with a volatility higher than water and for example higher than the liquid to be atomized. For example, the compounds of the additive may have an evaporation number less than 10, less than 8, less than 5, less than 2.5, and for example of 8.3. Alternatively, the compounds of the additive may have an evaporation rate greater than 3, greater than 5 or greater than 8, for example an evaporation rate of 3.8.

Furthermore, the additive comprises a flavored material and/or nicotine, wherein the flavored material and/or the nicotine exits the second storage volume 42 at room temperature and under ambient pressure by evaporation without heating or other action of the atomizer 26 or of another atomizer.

The flavored materials are for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavoring materials, such as anethole, limonene, linalool, eugenol and the like or hydrophilic flavor components such as a leaf tobacco extract or natural plant flavoring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavored materials as mentioned above into new flavored materials. Moreover, it is possible to adsorb any flavor onto a solid material and to use this material as flavored material within an electronic smoking device according to the present invention.

Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water for example, at least one and in particular of the flavor and/or of the aroma compound of the compounds of the additive may have evaporation numbers between 3.8 and 10. In general, aroma compounds are highly volatile and this is the reason why we can smell them at room temperature. In case the flavor and/or the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes.

The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

The additive inlet opening 50 is shown arranged between the liquid outlet 46 or the liquid outlets 46, 48 and the air inhalation port 36 along the flow path F for atomized liquids, the flow path F extending from the atomizer 26 to the air inhalation port 36. For example, the flow path F can at least partly or even completely extend along the longitudinal direction L, such that the additive inlet opening 50 is shown arranged between the liquid outlet 46 or the liquid outlets 46, 48 and the air inhalation port 36 along the longitudinal direction L. Hence, the fluid outlet 50 is arranged downstream of the atomizer 26 along the flow path F.

The lateral surface 52 at least section-wise defines the flow path F for the atomized liquid. The flow path F extends to the air inhalation port 36, e.g. from the atomizer 26, wherein the additive inlet 50 is arranged downstream of the liquid outlet 46 or the liquid outlets 46, 48 and/or of the atomizer 26 along the flow path F.

A liquid supply assembly 54 for an electronic smoking device 10 may be provided as a replaceable component for the electronic smoking device 10 and comprises the liquid reservoir 34 and optionally a part of the outer housing 11, e.g. of the hollow tube, in which the liquid reservoir 34 is arranged. Hence, the liquid supply assembly 54 can be atomizer-free and can be added to an electronic smoking device 10 that already comprises the atomizer 26. In case the liquid supply assembly 54 comprises the atomizer 26, the liquid supply assembly may be designated as atomizer/liquid reservoir portion 14 or as cartomizer.

The liquid reservoir 34 may comprise a single compartment or more than one compartment, in which the storage volume 40 is arranged.

The electronic smoking device 10, the atomizer/the liquid reservoir portion 14 and/or the liquid supply assembly 54, for example their outer housing 11, comprise an outer diameter D1 that may be essentially constant along the longitudinal direction.

Figure 2:
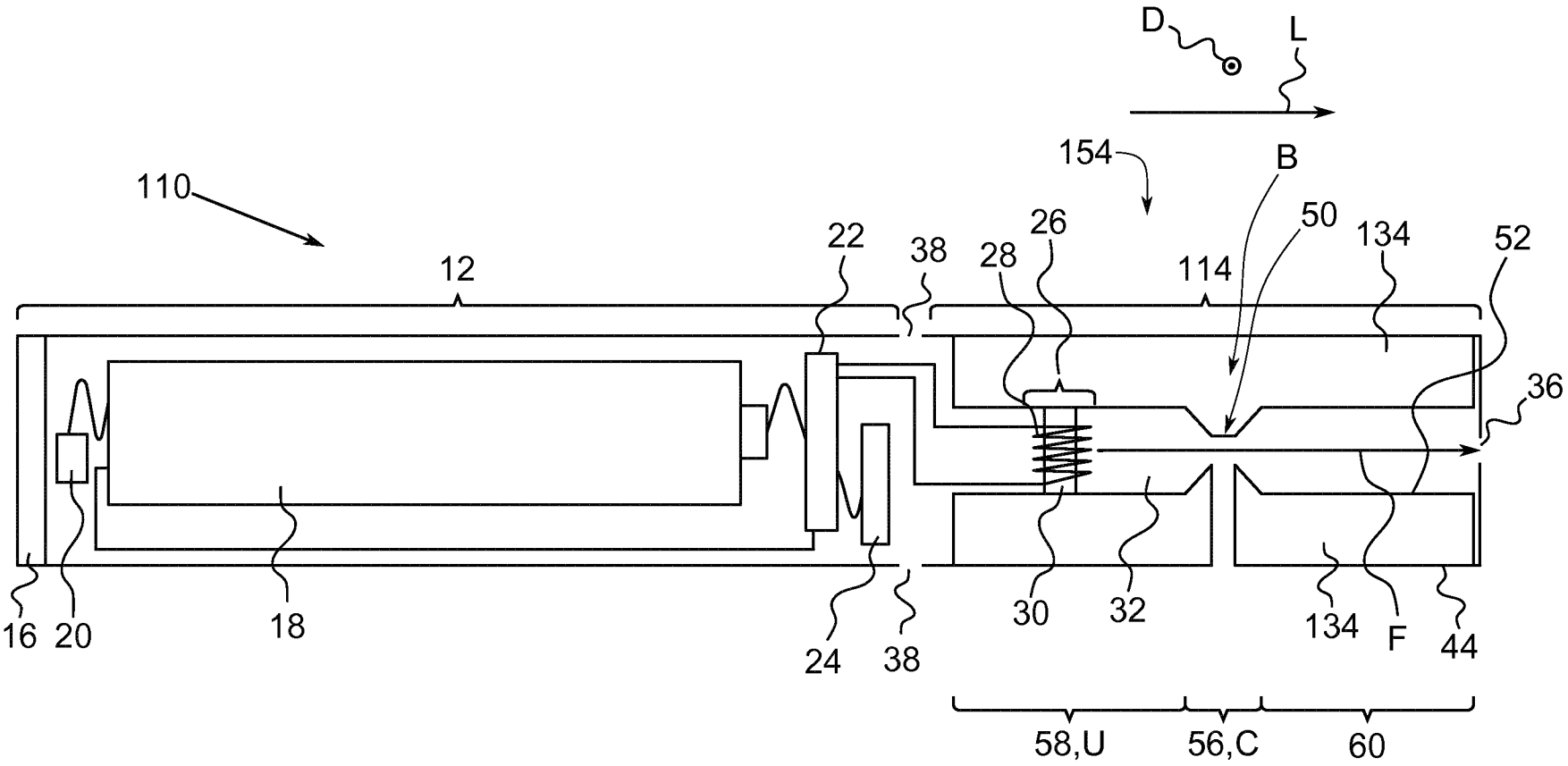
FIG. 2 shows another exemplary embodiment of the electronic smoking device schematically in a cross-sectional view.

FIG. 2 shows another exemplary embodiment of the electronic smoking device with the atomizer/liquid reservoir portion and the liquid reservoir. For the sake of brevity, only differences from the exemplary embodiment of FIG. 1 are looked at.

FIG. 2 shows the liquid reservoir 134 arranged in the atomizer/liquid reservoir portion 114 that, together with the battery portion 12, forms the electronic smoking device 110.

A first section 56 of the lateral surface 52 protrudes from a second section 58 of the lateral surface 52, thereby forming a constricted segment C of the duct 32. In case a user sucks on the air inhalation port 36, gas flows faster through the constricted segment C than through an unconstricted segment U of the duct 32 adjacent to the second section 58, the unconstricted segment U being arranged before the constricted segment C along the flow path F. Thus, within the constricted segment C, reduced pressure exists compared to the pressure in the unconstricted segment U in case gas or aerosol flows along the flow path F towards the air inhalation port 36.

Along the flow path F, a third section 60 of the lateral surface 52 follows the first section 56, from which the first section 56 protrudes. In the area of the second section 58 and in the area of the third section 60, a diameter of the central passage 32 to be measured perpendicular to the longitudinal direction L is essentially the same. Yet, in the area of the first section 56, the diameter perpendicular to the longitudinal direction L of the central passage 32 is reduced compared to the diameter of the second or the third sections 58, 60.

In case the first section 56 extends around the flow path F in a circumferential direction D of the duct 32, the circumferential direction D extending perpendicular to the longitudinal direction L, the first section 54 forms a bead B, which symmetrically constricts the duct 32 in the constricted segment C.

The additive inlet opening 50 is arranged in the first section 56. Due to the reduced pressure, gas or aerosol, e.g. additive stored in the additive reservoir is drawn through the additive inlet conduit 42 into the duct 32, e.g. the central passage.

The liquid supply assembly 154 of this exemplary embodiment comprises a liquid reservoir with the first section 56.

Figure 3:
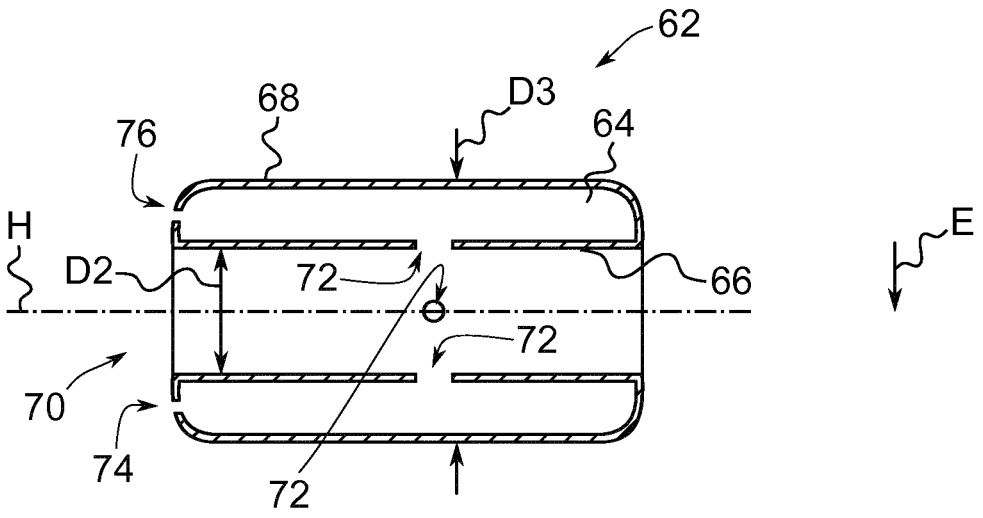
FIG. 3 schematically shows a cross-sectional view of an exemplary embodiment of an additive reservoir.

FIG. 3 shows an exemplary embodiment of an additive reservoir for the electronic smoking device 10 in a cross-sectional view, wherein the cross-section extends along a central axis of the additive reservoir.

The additive reservoir 62 comprises an additive storage volume 64 that is arranged between an inner lateral surface 66 and an outer lateral surface 68 of the additive reservoir 62. The inner lateral surface 66 at least section-wise extends around a central axis H of the additive reservoir 62 for more than 180°. For example, the additive reservoir 62 completely extends around the central axis H for more than 180°. The additive reservoir 62 has e.g. a C-shaped cross section perpendicular to the central axis H and opens perpendicular to the central axis C. In FIG. 3, however, the inner lateral surface 66 completely surrounds the central axis C. The inner lateral surface 66 extends along the central axis H. In a mounted state, in which the additive reservoir 62 is combined with the outer housing 11, the central axis H of the additive reservoir 62 corresponds to the central axis A.

In case the additive reservoir 62 extends less than 360° and for example 220° around the central axis H, the additive reservoir 62 can be snapped on the outer housing 11 and in particular on the outer lateral side 44 perpendicular to the central axis H and is an additive reservoir snap-on. In case the additive reservoir 62 completely extends around the central axis H, the additive reservoir 62 is an additive reservoir sleeve, into which the outer housing 11 can be inserted at least partially.

Hence, through the additive reservoir 62, a through hole channel 70 extends along the central axis H, such that the outer housing 11 can be at least partly inserted into the additive reservoir 62 and into its through hole or channel 70, along or perpendicular to the central axis H, such that the flow path F extends through the additive reservoir 62 and in particular through the through hole or channel 70.

The additive reservoir 62 comprises at least one additive outlet opening 72 in the inner lateral surface 66. The additive outlet opening 72 opens the additive storage volume 64 towards the central axis H and for example into the through hole or channel 70.

In particular, in case the electronic smoking device 10, 110, e.g. the additive supply assembly 54, 154 comprises more than one additive inlet conduit 42, the additive reservoir 62 comprises more than one additive outlet opening 72. The additive outlet openings 72 are arranged at a distance to each other in a circumferential direction E of the additive reservoir 56. The circumferential direction E of the additive reservoir 62 corresponds to the circumferential direction D of the electronic smoking device 10 in the mounted state of the additive reservoir 62.

The amount, size and/or arrangement of the additive outlet opening 72 or the additive outlet openings 72 can correspond to the amount, size and arrangement of the additive inlets 50 in case the additive reservoir 62 is in its mounted state.

Hence, the additive outlet openings 72 can be arranged rotationally symmetric around the central axis H. In case the additive reservoir 62 comprises exactly two additive outlet openings 72, the two additive inlets 50 are for example arranged opposite of each other with respect to the central axis A.

A total dimension of the inner lateral surface 66 around the central axis H and for example in the circumferential direction E can be equal to or greater than a total dimension of the at least one additive outlet opening 72 around the central axis H. In case the additive reservoir 62 comprises more than one additive outlet opening 72, the total dimension of all of the additive outlet openings 72 is smaller than the total dimension of all sections of the inner lateral surface 66 that are arranged between or after the additive outlet openings 72 in the circumferential direction E.

The atomizer/liquid reservoir portion 14, 114 or the liquid supply assembly 54, 154 and the additive reservoir 62 can be provided separately from each other. Alternatively, the liquid supply assembly 54, 154—with or without the atomizer 26 and the additive reservoir 62 can form a kit, for example a retrofit kit for the electronic smoking device 10, 110. The kit can be used to replace liquid to be atomized and an additive.

A maximum distance of different sections of the inner lateral surface 66 essentially corresponds to the outer diameter D1. For example, an inner diameter D2 of the through hole or channel 70 essentially corresponds to the outer diameter D1.

Optionally, a front face 74 of the additive reservoir 62 may comprise at least one air inlet opening 76. The front face 74 faces away from the air inhalation portion 36 in the mounted state of the additive reservoir 62.

The outer housing 11 can form a rotational bearing for the additive reservoir 62. Hence, the additive reservoir 62 can be rotated around the central axis A even if the additive reservoir 62 is mounted. When rotating the additive reservoir 62 in or against the circumferential direction D, the at least one additive outlet opening 66, 72 can be brought in overlap with the at least one additive inlet conduit 42, such that additive can exit the additive reservoir 62 via the at least one additive outlet opening 72 and can enter the flow path F via the at least one additive inlet conduit 42. Due to the rotational arrangement of the additive reservoir 62, an overlapping area of the at least one additive outlet opening 72 and the at least one additive inlet conduit 42 can be varied, such that the amount of additive entering the flow path F in a predetermined time period can be changed.

A total dimension of a closed section or of closed sections of the outer lateral surface 44 along the circumferential direction D is equal to or greater than the total dimension of the at least one additive inlet conduit 42 or of all additive inlet conduits 42 in the circumferential direction D. Hence, it is possible to rotate the additive reservoir 62 into a storage position, in which a minimum amount of or even no additive leaves the additive reservoir 62 and enters the flow path F.

A maximum outer diameter D3 of the additive reservoir 62 may be greater than the outer diameter D1. Hence, when mounted, the additive reservoir 62 protrudes from the outer housing 11 perpendicularly to the central axis A.

Figure 4:
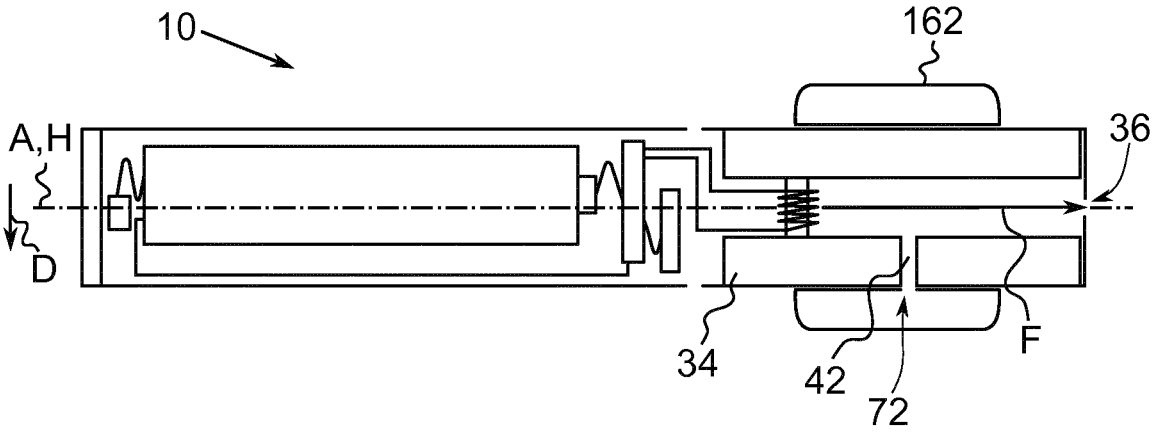
FIG. 4 is a schematic cross-sectional illustration of the electronic smoking device according to the exemplary embodiment of FIG. 1 and the additive reservoir of the exemplary embodiment of FIG. 3.

FIG. 4 shows the electronic smoking device 10 with an additive reservoir 162 in its mounted state, in which the electronic smoking device 10 is ready for use. The additive reservoir 162 can be rotated in the circumferential direction D with respect to the central axis A and for example with respect to the liquid reservoir 34 in order to adapt the amount of additive to be added to atomized liquid that travels along the flow path F towards the air inhalation port 36.

Compared to the additive reservoir 62 of the exemplary embodiment of FIG. 3, the additive reservoir 162 comprises no air inlet opening 76. The at least one additive outlet opening 72 is in communication with the additive inlet conduit 42.

The electronic smoking devices 10, 110 may each be combined with any of the additive reservoirs 62, 162.

Figure 5:
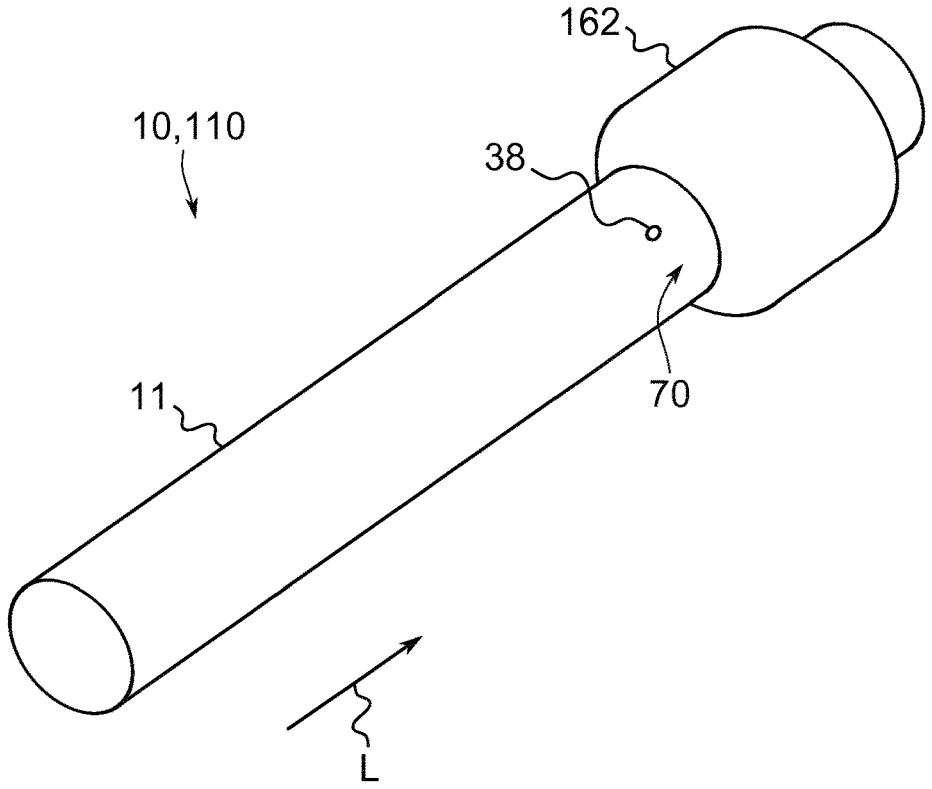
FIG. 5 shows the electronic smoking device according to one of the exemplary embodiments of FIGS. 1 and 2 with the additive reservoir of the exemplary embodiment of FIG. 3 in a perspective view.

FIG. 5 shows the exemplary embodiment of FIG. 4 in a schematic perspective view with the additive reservoir 162 being fitted over the outer housing 11 of the electronic smoking device 10, 110 in a schematic perspective view. The additive reservoir 162 is formed as a sleeve and the outer housing 111 is inserted into the receiving channel 70 extending through the sleeve along the longitudinal direction L. Alternatively, the additive reservoir 162 and the additive reservoir 62 according to the exemplary embodiment of FIG. 3 is formed as a snap-on additive reservoir, that can be snapped onto the outer housing 11 perpendicular to the longitudinal direction L.

The air inlet 38 is arranged at a distance to the additive reservoir 162 parallel to the longitudinal direction L. In particular, the air inlet 38 is arranged before the additive reservoir 162 in the longitudinal direction L and for example between the end cap 16 and the additive reservoir 162.

The outer housing 11 may protrude from the additive reservoir 162 (or from the additive reservoir 62) in both opposite directions along the longitudinal direction L.

Figure 6:
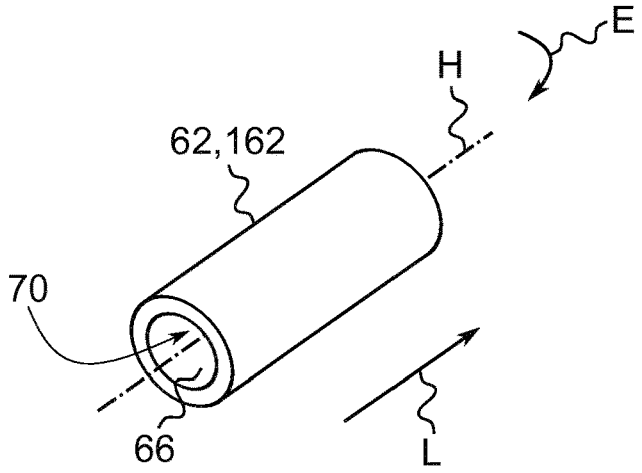
FIG. 6 shows the additive reservoir of the exemplary embodiment of FIG. 3 in a schematic perspective view.

FIG. 6 schematically shows the additive reservoir 62, 162 in a perspective view. The central axis H extends through the additive reservoir 62, 162 along the longitudinal direction L, in case the additive reservoir 62, 162 is mounted onto the outer housing 11. The inner lateral surface 66 extends around the central axis H in the circumferential direction E, for example for more than 180°. In case the inner lateral surface 66 completely extends around the central axis H or it extends around the central axis H for more than 270°, the additive reservoir 62, 162 may be designated as a sleeve. In case the inner lateral surface 66 extends around the central axis H for more than 180° and for example less than 270°, the additive reservoir 62, 162 is a snap-on reservoir. In case the inner lateral surface 66 extends less than 180° around the central axis H, the additive reservoir 62, 162 may be attached to the outer housing 11 in order to releasably fix the additive reservoir 62, 162, for example by bonding.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

According to an embodiment, an electronic smoking device is provided, the electronic smoking device comprising an air inhalation port and an outer housing, in which an atomizer, a liquid reservoir for liquid to be atomized by the atomizer and a duct that interconnects the atomizer with the air inhalation port, are arranged. The electronic smoking device comprises at least one additive inlet conduit that interconnects the duct and the surroundings of the electronic smoking device, the at least one additive inlet conduit extending through an outer lateral side of the outer housing. The electronic smoking device further comprises an additive reservoir with a receiving channel and with an additive outlet opening that opens into the receiving channel. The additive reservoir is detachably fixed at the outer housing and the at least one additive inlet conduit is in communication with the additive inlet opening. According to another aspect, an additive reservoir for an electronic smoking device is provided. For example, the electronic smoking device is the electronic smoking device according to the above embodiment. The additive reservoir can be provided separately from other components of the electronic smoking device, e.g. as a retrofit kit. The additive reservoir comprises an additive storage volume, a receiving channel and an inner lateral surface arranged between the additive storage volume and the receiving channel. The additive reservoir comprises at least one additive outlet opening that interconnects the additive storage volume and the receiving volume.

An advantage of the electronic smoking device and of the additive reservoir according to the embodiments may be that additive can be added to the vaporized liquid at the user's choice, simply by adding the additive reservoir to the remaining electronic smoking device or by exchanging the additive reservoir with another additive reservoir. As the outer housing is placeable in the receiving channel and, thus, the additive reservoir extends at least section-wise around the outer housing, the additive storage volume of the additive reservoir may be comparably large, such that a large amount of additive can be provided with the additive reservoir.

The additive may comprise compounds with a volatility higher than water. The compounds may have an evaporation number of less than 10, less than 8, less than 5 or less than 2.5, for example an evaporation number of 8.3. The compounds may have an evaporation rate of more than 3, more than 5, or more than 8, for example an evaporation rate of 3.8.

Volatility is the tendency of a compound to become volatile/vaporized and it is directly related to the vapor pressure of said compound. At a given temperature and pressure, the volatility and, hence, vapor pressure of a compound is constant. The volatility of at least one and in particular of the flavor and/or of an aroma of the compounds of the additive may be provided with respect to the one of water, which may have a volatility of "1" and may be called evaporation number. A compound with a higher evaporation number than water has a higher vapor pressure than water—for example, at least one and in particular of the flavor and/or the aroma compound of the compounds of the additive may have evaporation numbers between 3.8 and 10. In general, aroma compounds are highly volatile and this is the reason why we can smell them at room temperature. In case the flavor and/or of the aroma compound has a volatility that is insufficient for the compound to be vaporized during use of the electronic smoking device, the flavor and/or of the aroma compound may be combined and for example mixed with another material with a sufficient volatility that entrains the flavor and/or of the aroma compound when the other material vaporizes.

The evaporation number may be defined as the ratio of time spent to completely evaporate a certain amount of solvent at 20° C. temperature and 65% relative humidity, to the time spent to completely evaporate the same amount of a reference solvent under same conditions. For example, diethyl ether or n-butyl acetate may be used as the reference solvent.

According to a possible embodiment of the electronic smoking device, the additive outlet opening and the additive inlet conduit can be brought out of and into communication with each other in case at least a section of the outer housing is arranged in the additive reservoir. An advantage of this aspect may be that in case the additive outlet opening and the additive inlet conduit are in communication with each other, additive can enter the duct. Furthermore, the additive outlet opening can be brought out of communication with the additive inlet conduit for example by a movement of the additive reservoir relative to the outer housing. This movement may be a rotational movement along a circumferential direction of the outer housing. Alternatively, the movement may be a translational movement of the additive reservoir with respect to the outer housing. Hence, supply of additive to the vaporized liquid can be stopped or initiated at the user's choice.

For example, in case the additive outlet opening and the additive inlet conduit are in communication with each other, the additive outlet opening may at least section-wise or even completely overlap the additive inlet conduit. By the relative movement, the overlap may be reduced until zero, such that the amount of additive entering the additive inlet conduit can be decreased until zero.

The at least one additive inlet conduit opens into the duct with an additive inlet opening, wherein the additive inlet opening is arranged between the atomizer and the air inhalation port. An advantage of this possible embodiment may be that the additive does not pass the atomizer, thereby avoiding that the additive is affected, for example by heat, by the atomizer. Furthermore, another advantage may be that additive does not reach an optional wick of the atomizer, such that mixing of consecutively used additives in the wick is avoided.

The duct may comprise a constricted section, wherein the at least one additive inlet opening is arranged in the constricted section. Due to the constricted section, a pressure within the constricted section of gas flowing through the duct decreases, thereby increasing the amount of additive flowing through the additive inlet conduit towards the duct.

The constricted section may be arranged between a leading and a trailing section of the duct. The minimum inner diameter of the constricted section is smaller than inner diameters of the leading and the trailing sections, at least adjacent to the constricted section. An advantage of this embodiment may be that the constricted section can be easily formed.

The electronic smoking device may comprise a one-way valve that is normally closed and that shuts or closes up the at least one additive inlet opening in its closed state. The valve may be placed inside of the additive inlet conduit. In case the electronic smoking device comprises a plurality of additive inlet conduits, each of the conduits may comprise one one-way valve that is normally closed. The one-way valve provides that no gas unintentionally flows through the additive inlet conduit. Further, the valve is also provided to make sure that the additives only go out and nothing comes in, in order to avoid contamination. For example, the one-way valve is adapted to be actuated by introducing the outer housing into the receiving channel. Hence, an advantage of such an embodiment may be that the electronic smoking device can be used without the additive reservoir, wherein air cannot be sucked in via the additive inlet conduit and affects vaping experience by unintentional dilution of vaporized liquid. In case the one-way valve is adapted to be actuated by introducing the outer housing into the receiving channel, no further action is required from the user in order to operate the valve or the valves.

Alternatively or additionally, a valve may be provided in the duct, for example between the atomizer and the additive inlet opening. An advantage of such an embodiment may be that a user can exhale via an opening of the electronic smoking device, e.g. the or at least one of the additive inlet openings, in case no additive reservoir covers the additive inlet conduit or is connected to the additive inlet opening in an additive-transmitting manner. This embodiment may be advantageous for medical applications, in which the patient cannot readily remove the device for exhaling. Hence, the electronic smoking device may be a medical device or medical inhaler, even in case no valve is present in the duct.

The electronic smoking device may comprise more than one additive inlet conduit and/or the additive reservoir may comprise more than one additive outlet opening, wherein the additive inlet conduits are arranged at a distance to each other and/or the additive outlet openings are arranged at a distance to each other in a circumferential direction of the outer housing and/or of the additive reservoir, for example of the receiving channel. An advantage of this embodiment may be that additive can be supplied to the atomized liquid with an optimized and for example uniform distribution.

For example, the additive inlet conduits are arranged rotationally symmetric around a central axis of the duct and/or the additive outlet openings are arranged rotationally symmetrical around a central axis of the receiving channel. An advantage of this possible embodiment may be that usage of the electronic smoking device may be facilitated as more than one predetermined rotational position of the additive reservoir on the outer housing exists, in which additive can flow from the additive reservoir to the duct via the additive inlet conduit.

In case the additive reservoir comprises exactly two additive outlet openings, the two additive outlet openings can be arranged opposite of each other. If the electronic smoking device comprises exactly two additive inlet conduits, the two additive inlet conduits can be arranged opposite of each other. An advantage of this possible embodiment may be that production of the additive reservoir and/or of the electronic smoking device can be facilitated, as the two additive outlet openings and, similarly, the two additive inlet conduits, can both be formed simultaneously with a tool, e.g. a drill or a slider of an injection molding tool. Alternatively, the at least two or exactly two additive outlet openings and/or the at least two or exactly two additive inlet conduits can be arranged different, e.g. on the same side of the duct that may be the central passage. In case more than one reservoir is provided, the reservoirs can be arranged in parallel to each other and not just opposite by having two outlets (one at the bottom and one at the top).

The receiving channel may extend along a longitudinal direction of the additive reservoir and may be completely closed perpendicular to the longitudinal direction, such that the additive reservoir is an additive reservoir sleeve, wherein the additive reservoir sleeve is adapted such that the outer housing is introducible into the additive reservoir sleeve along the longitudinal direction. Alternatively, the receiving channel extends along the longitudinal direction of the additive reservoir and opens perpendicular to the longitudinal direction, such that the additive reservoir is an additive reservoir snap-on that is adapted to be snapped onto the outer housing perpendicular to the longitudinal direction.

The electronic smoking device may comprise a fastening element for fastening the additive reservoir. The additive reservoir may comprise a counter fastening element for fastening the additive reservoir to the outer housing. For example, the fastening element may be a latch element and the counter fastening element may be a counter latch element for the fastening element. Alternatively, the fastening elements can be inner and outer threads, wherein the outer thread may extend around the outer housing and the inner thread may be arranged on the inner lateral surface of the additive reservoir. As another alternative, the fastening elements can be bonding elements, for example double-faced adhesive tape.

LIST OF REFERENCE SIGNS

10, 110 electronic smoking device
11 outer housing
12 battery portion
14, 114 atomizer/liquid reservoir portion
16 end cap
18 battery
20 light-emitting diode (LED)
22 control electronics
24 airflow sensor
26 atomizer
28 heating coil
30 wick
32 duct
34, 134 liquid reservoir
36 air inhalation port
38 air inlets
40 storage volume
42 additive inlet conduit
44 outer lateral surface
46, 48 liquid outlet
50 additive inlet opening
52 inner lateral surface
54, 154 liquid supply assembly
56, 58, 60 first, second and third section
62, 162 additive reservoir
64 additive storage volume
66 inner lateral surface
68 outer lateral surface
70 through hole/channel
72 additive outlet opening
74 front face
76 air inlet opening
A central axis
B bead
C constricted section
D circumferential direction
D1 outer diameter
D2 inner diameter
D3 outer diameter
E circumferential direction
F flow path
H central axis
L longitudinal direction
U unconstructed section

The invention claimed is:

1. An electronic smoking device comprising:
an outer housing including an air inhalation port;
an atomizer;
a liquid reservoir for liquid to be atomized by the atomizer;
a duct that interconnects the atomizer with the air inhalation port;
at least one additive inlet conduit that interconnects the duct with an outer lateral surface of the outer housing; and
an additive reservoir including a receiving channel extended through the additive reservoir and configured for receiving the outer housing at least partially therein to detachably fix the additive reservoir to the outer housing, the additive reservoir further including an additive outlet opening in the receiving channel, the additive outlet opening in communication with a storage volume of the additive reservoir; and when the additive reservoir is fixed to the outer housing the additive outlet opening is in communication with the at least one additive inlet conduit.

2. The electronic smoking device according to claim 1, wherein the additive outlet opening and the additive inlet conduit can be brought in communication with each other when at least a section of the outer housing is arranged in the receiving channel.

3. The electronic smoking device according to claim 1, wherein the at least one additive inlet conduit opens into the duct with an additive inlet opening, wherein the additive inlet opening is arranged between the atomizer and the air inhalation port.

4. The electronic smoking device according to claim 1, wherein the duct comprises a constricted section, the at least one additive inlet opening arranged in the constricted section.

5. The electronic smoking device according to claim 4, wherein the constricted section is arranged between a leading and a trailing section of the duct, the minimum inner diameter of the constricted section being smaller than at least the inner diameters of the leading and the trailing sections adjacent to the constricted section.

6. The electronic smoking device according to claim 1, wherein the electronic smoking device comprises a one-way valve that is normally closed to shut the at least one additive inlet opening.

7. The electronic smoking device according to claim 6, wherein the one-way valve is adapted to be actuated by introducing the outer housing into the receiving channel.

8. The electronic smoking device according to claim 1, wherein the electronic smoking device comprises more than one additive inlet conduit and/or the additive reservoir comprises more than one additive outlet opening, wherein the additive inlet conduits are arranged at a distance to each other and/or the additive outlet openings are arranged at a distance to each other in a circumferential direction of the outer housing or of the additive reservoir.

9. The electronic smoking device according to claim 8, wherein the additive inlet conduits are arranged rotationally symmetric around a central axis of the duct, and/or the additive outlet openings are arranged rotationally symmetric around a central axis of the additive reservoir.

10. The electronic smoking device according to claim 8, wherein the additive reservoir comprises exactly two additive outlet openings arranged opposite of each other, and/or the electronic smoking device comprises exactly two additive inlet conduits arranged opposite of each other.

11. The electronic smoking device according to claim 1, wherein the additive reservoir extends along a longitudinal direction of the additive reservoir and is completely closed perpendicular to the longitudinal direction, such that the additive reservoir is an additive reservoir sleeve, wherein the additive reservoir sleeve is adapted such that the outer housing is introducible into the additive reservoir sleeve.

12. The electronic smoking device according to claim 1, wherein the additive reservoir extends along a longitudinal direction of the additive reservoir and opens the receiving channel perpendicular to the longitudinal direction, such that the additive reservoir is an additive reservoir snap-on that is adapted to be snapped onto the outer housing.

13. The electronic smoking device according to claim 1, wherein the electronic smoking device comprises a fastening element for fastening the additive reservoir, and the additive reservoir comprising a counter fastening element for fastening the additive reservoir to the outer housing.

14. An additive reservoir for an electronic smoking device, comprising an additive storage volume, a receiving channel extended through the additive reservoir and configured for receiving an outer housing of the electronic smoking device at least partially therein to detachably fix the additive reservoir to the electronic smoking device, the additive reservoir further including an additive outlet opening in the receiving channel, the additive outlet opening in communication with a storage volume of the additive reservoir.

15. The additive reservoir according to claim 14, wherein the additive reservoir comprises a counter fastening element for fastening the additive reservoir to the electronic smoking device.

16. The additive reservoir according to claim 14, wherein the additive reservoir comprises a plurality of additive outlet opening and the additive outlet openings are arranged at a distance to each other in a circumferential direction of the additive reservoir.

17. The additive reservoir according to claim 16, further comprising a plurality of additive inlet conduits arranged rotationally symmetric around a central axis of the additive reservoir.

18. The additive reservoir according to claim 17, wherein the additive reservoir comprises exactly two additive outlet openings arranged opposite of each other.

19. The additive reservoir according to claim 14, wherein the additive reservoir is a sleeve that is completely closed around a longitudinal direction of the additive reservoir, and wherein the sleeve is adapted such that an outer housing of an electronic smoking device is introducible into the receiving channel.

20. The additive reservoir according to claim 14, wherein the additive reservoir is a C-shaped sleeve that is adapted to be snapped onto an outer housing of an electronic smoking device.

* * * * *